United States Patent [19]

Sakuma et al.

[11] Patent Number: 4,566,396

[45] Date of Patent: Jan. 28, 1986

[54] THREAD FEED MECHANISM IN SEWING MACHINE

[75] Inventors: Kuniharu Sakuma; Sumio Goto, both of Tokyo, Japan

[73] Assignee: Tokyo Juki Industrial Co., Ltd, Chofu, Japan

[21] Appl. No.: 655,345

[22] Filed: Sep. 27, 1984

[51] Int. Cl.[4] ..... D05B 45/00

[52] U.S. Cl. ..... 112/302; 112/278; 112/453

[58] Field of Search ..... 112/302, 273, 278, 241, 112/254, 255, 243, 453

[56] References Cited

U.S. PATENT DOCUMENTS

| | | | |
|---|---|---|---|
| 4,215,641 | 8/1980 | Dobrjanskyj et al. . | |
| 4,267,787 | 5/1981 | Fukuda | 112/272 X |
| 4,289,087 | 9/1981 | Takenoya et al. . | |
| 4,408,554 | 10/1983 | Takiguchi et al. | 110/302 |

FOREIGN PATENT DOCUMENTS

| | | |
|---|---|---|
| 2924018 | 1/1980 | Fed. Rep. of Germany . |
| 3102048 | 12/1981 | Fed. Rep. of Germany . |
| 2015596 | 9/1979 | United Kingdom . |

*Primary Examiner*—Peter Nerbun

*Attorney, Agent, or Firm*—Yount & Tarolli

[57] ABSTRACT

A thread feed mechanism in a sewing machine for paying-out thread in a predetermined amount necessary for forming one seam. The thread feed mechanism comprises a first signal generation device for producing feed amount and needle bar amplitude signals, a second signal generation device for producing a workpiece thickness signal, first means for adding square values of feed amount and amplitude signals, second means for multiplying a square root of the first means by a coefficient, third means for producing a signal varying depending upon the operation mode thereof, fourth means for multiplying a workpiece thickness signal by the output of the third means, and fifth means for adding the outputs of the second, third and fourth means.

2 Claims, 6 Drawing Figures

THREAD FEED MECHANISM IN SEWING MACHINE

BACKGROUND OF THE INVENTION

This invention relates to a thread feed mechanism in a sewing machine which is adapted to feed a predetermined length of thread necessary for forming one seam at one time from a supply source of thread to a thread take-up lever by a paying-out device which operates based on set signals and more particularly, to computing of the set signals.

In the sewing machine thread feed mechanism of the above type, the length l of thread necessary for forming one seam can be sought by the equation $l=K_1P+K_2D+Z$, and seam pitch is given by the equation $P=\sqrt{x^2+y^2}$, wherein X is workpiece feed pitch, Y is amplitude of needle bar, D is sewn workpiece thickness, Z is thread amount necessary for entwining and K is coefficient.

One example of thread paying-out devices which operate based on signals computed by the above-mentioned equation comprises two holding means for releasably pinching an indefinite length of thread and a thread paying-out member disposed in the thread path extending between the two holding means for operating in synchronization with a thread take-up lever whereby when the lever is not straining the thread, one of the holding means adjacent to a supply source of thread opens to release the thread from the nip whereas the other holding means adjacent to the lever closes to increase the length of the thread path extending between the two holding means so as to pay the thread out of the supply source, in response to the paying-out of the thread by a preset amount, the holding means adjacent to the supply source closes to prevent the thread from being further paid out and the holding means adjacent to the lever opens and the paid out thread is drawn out of the zone between the two holding means as the lever rises again. In another example of the thread paying-out devices of the type referred to above, a disc having a length of thread wound about the periphery of the disc is provided or a pair of rollers are provided in opposing and spaced relationship to releasably pinch the thread therebetween and at least one of the rollers is intermittently rotated by a stepping motor each time one seam is formed. In a further example of the thread paying-out devices of the type referred to hereinabove, a pair of spaced thread guides are provided in the thread path, a reciprocal paying-out member is provided to traverse the thread path and the movement amount of the reciprocal paying-out member is related to the movement amount of drive means such as a pulse motor or linear motor. However, the prior art thread paying-out devices referred to above have the disadvantage that since the balance in tension between upper and lower threads can not be varied as desired, the thread paying-out devices are not applicable to some sewing operations in which a single workpiece is sewn with gathers and two workpieces having different lengths are sewn together with the longer workpiece gathered.

In sewing machines, conventionally, the workpiece feed amount has been mechanically adjusted to square the feed amount in the forward direction with that in the reverse direction. However, differences between absolute feed amounts in the forward and reverse directions due to variation in tolerances of parts or disaccordance between an actual workpiece feed amount and a predetermined workpiece feed amount corresponding to the position of a feed adjusting device or a workpiece feed amount indicated by an adjusting dial or the like interlocked with the feed adjusting device could not be adjusted.

Therefore, in the workpiece feed amount adjusting system described just above, when a signal representing the detected position of the workpiece feed amount adjusting device and a control signal of a pulse motor which is adapted to displace the adjusting device are employed as workpiece feed amount signals for computing a thread paying-out amount, excess and deficiency in thread feed amount occur resulting in a low quality sewn product.

SUMMARY OF THE INVENTION

Therefore, the present invention is to provide a novel and improved thread feed mechanism in a sewing machine which can effectively eliminate the disadvantages inherent in the prior art thread feed mechanism.

One important object of the present invention is to eliminate the disadvantages inherent in the prior art thread feed mechanisms by varying the coefficient $K_2$ of a workpiece thickness D.

A further object of the present invention is to maintain the balanced condition between upper and lower threads constant independent of variation in workpiece thickness.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

The present invention will be now described referring to the accompanying drawings in which one preferred embodiment of the present invention is illustrated.

Figure 1:
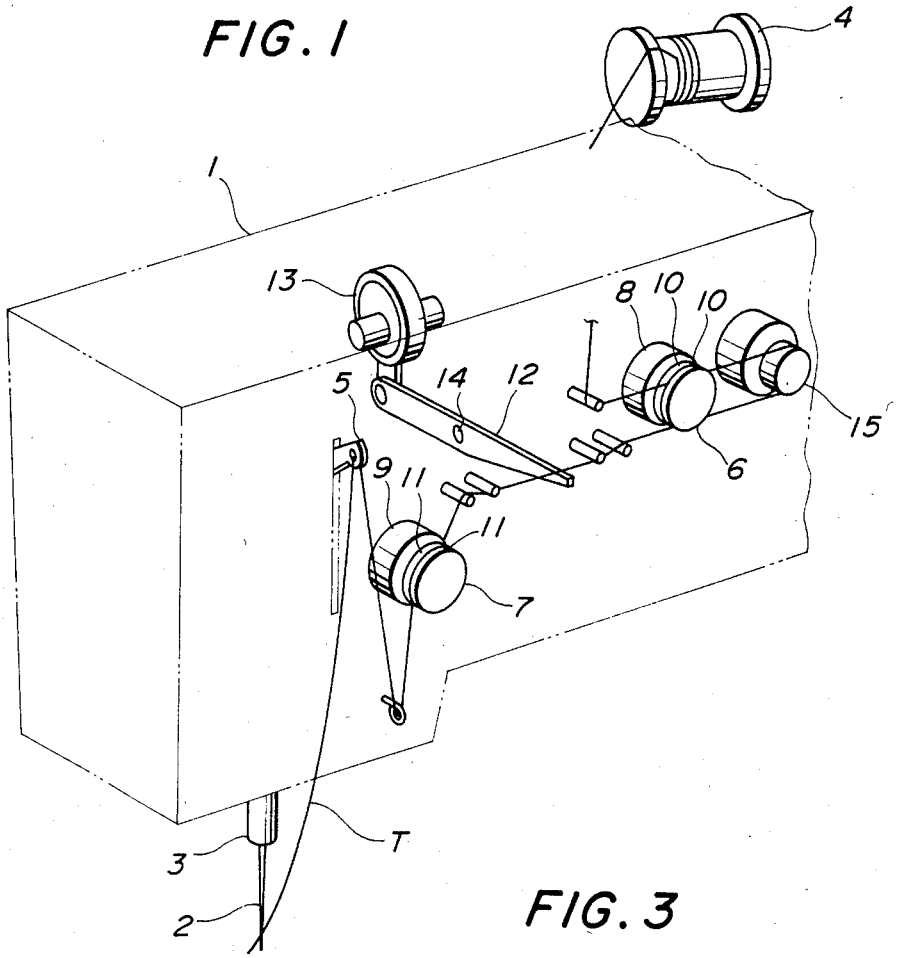
FIG. 1 is a fragmentary perspective view of the thread feed mechanism in a sewing machine embodying the present invention.
Figure 5:
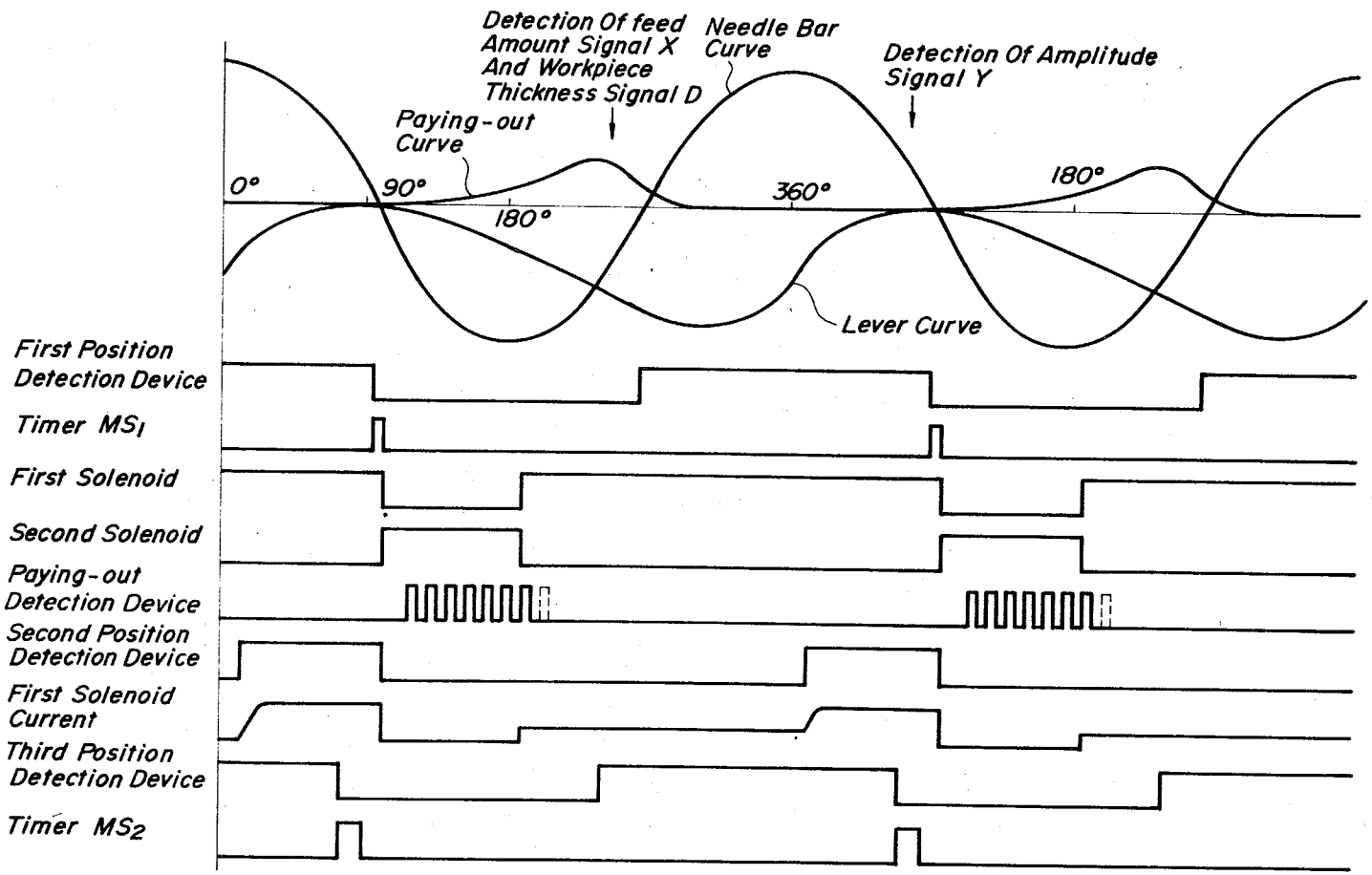
FIG. 5 is a time chart showing the operation of the thread feed mechanism.

First, referring to FIG. 1 of the drawings in which a conventional sewing machine 1 wherein the thread feed mechanism of the invention is incorporated is schematically shown and the sewing machine generally comprises a main shaft (not shown) operatively connected to a drive source (not shown) to be rotated by the drive source, a needle bar 3 having a needle 2 carrying a length of thread T secured to the lower end of the bar and interlocked with the main shaft for vertical movement as the main shaft rotates and a thread take-up lever 5 supporting the section of the thread T between a bobbin 4 and the needle 2 and movable between two positions as the main shaft rotates so as to strain and slacken the thread T. The relationship of the needle bar 3 and thread take-up lever 5 with respect to rotative angles of the main shaft is shown in FIG. 5.

First and second holding means 6 and 7 are provided in spaced upstream and downstream relationship in the thread path extending between the bobbin 4 and thread take-up lever 5. The first holding means consists of a first electromagnet or solenoid and a pair of holding discs 10 adapted to releasably pinch the thread T therebetween so that when the electromagnet 8 is excited the discs attract each other to releasably pinch the thread therebetween and when the electromagnet is demagnetized the discs separate from each other to release the thread from their nip. Similarly, the second holding means 7 consists of a second electromagnet or solenoid 9 and a pair of hold:ng discs 11. The functions of the electromagnet 9 and holding discs 11 are the same as those of the corresponding components of the first holding means 6.

A paying-out member 12 is rockably supported at one end to an eccentric cam 13 interlocked with the main shaft for rocking about a stub shaft 14 by a predetermined angle as the eccentric cam 13 rotates in response to the rotation of the main shaft. The free end of the paying-out member 12 intersects the thread path extending between the upstream and downstream holding means 6 and 7 so that when the point of the needle 2 is positioned below the upper surface of the bed of the sewing machine as shown in FIG. 5, the paying-out member 12 first engages the thread T to increase the length of the thread path between the holding means 6 and 7 and then minimizes the thread path length by the time when the lever 5 will strain the thread.

A rotatable member 15 is provided in the thread path extending between the holding means 6 and 7 and adapted to rotate by an angle in proportion to the movement distance of the thread T as the thread T moves along the thread path.

Electrical Circuit

Figure 2:
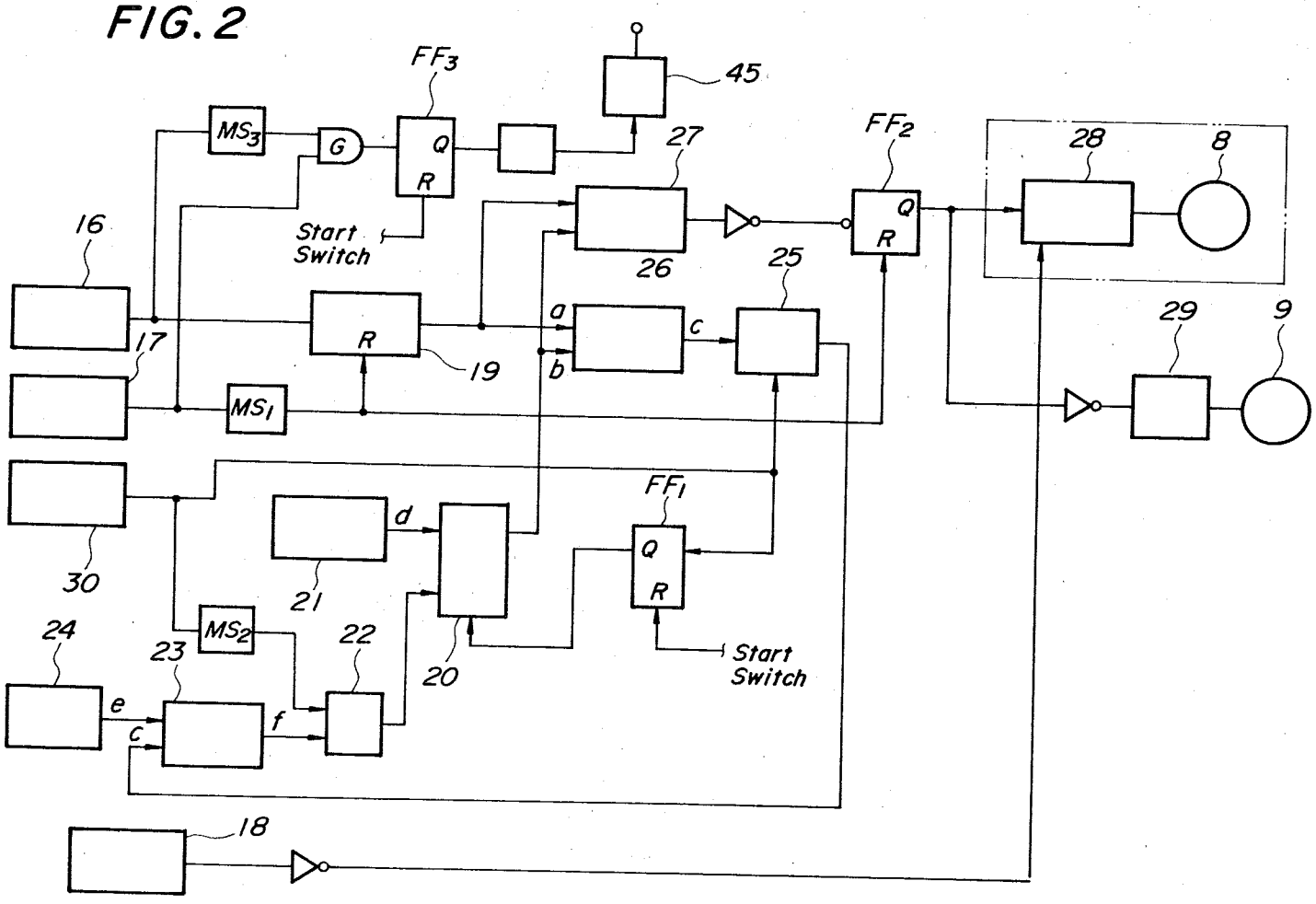
FIG. 2 is a block diagram of the electrical circuit for the thread feed mechanism.

FIG. 2 is a block diagram of the electrical circuit for use in the thread feed mechanism in a sewing machine according to the present invention. The operation sequence will be described referring to the electrical circuit, a paying-out detection device 16 produces one pulse each time the rotatable member 15 rotates by a predetermined angle. A first position detection device 17 is so disposed with respect to the main shaft or a member interlocked with the shaft that the device 17 detects a particular angle of rotation of the main shaft which corresponds to the time at which the lower end of the needle 2 is positioned above the upper surface of the sewing machine bed and outputs a higher level signal (which will be referred to as "signal H" herein) and the device 17 also detects another particular angle of rotation of the main shaft which corresponds to the time at which the lower end of the needle 2 is positioned below the upper surface of the sewing machine bed and outputs a lower level signal (which will be referred to as "signal L" herein). A second position detecting device 18 is so disposed with respect to the main shaft or a member interlocked with the main shaft that the device 18 detects a particular angle of rotation of the main shaft which corresponds to the time at which the thread take-up lever 5 strains the thread T and outputs one signal H. A counter 19 is set by the rise of a signal from a timer $MS_1$ which is actuated by the rise of a signal from the first position detection device 17 and counts pulses from the paying-out detection device 16.

A third position detection device 30 detects a particular angle of rotation of the main shaft which corresponds to the time period from the time just before the needle 2 invades into the sewing machine bed to the time just before the needle 2 rises out of the sewing machine bed and produces a signal H. A flip-flop $FF_1$ is reset by turning the start switch (not shown) for the sewing machine off and the reset of the flip-flop is released by turning the start switch on whereby an output at the terminal Q of the flip-flop $FF_1$ is inverted from L to H in response to the rise of an output from the third position detection device 30. A multiplexer 20 outputs an input signal from a first setting device 21 while the multiplexer is receiving a signal L from $FF_1$ and outputs an input signal from a holding circuit 22 while the multiplexer is receiving a signal H from $FF_1$. The holding circuit 22 operates in response to the rise of an output from a timer, $MS_2$ to receive an input signal from a subtracter 23 and at the same time to output. The subtracter 23 subtracts the value c of an output signal of a second holding circuit 25 of which description will be made hereinafter from the value e of a second setting device 24 to provide obtain a signal having the value f which is the output from the subtracter. The first and second setting devices 21 and 24 are adapted to set the length of the thread T to be payed out in proportion to the length of the thread T required for forming one seam. The first setting device 21 produces a digital code corresponding to an average ideal thread paying-out length for each selected seam pattern while the second setting means produces a digital signal corresponding to the thread length set for one seam formation as will be described hereinafter in connection with FIG. 4. The digital code is related to the number of pulses from the paying-out detection device 16 corresponding to an angle of rotation of the rotatable member 15 in proportion to the thread paying-out amount.

A second subtracter 26 subtacts the value b of an output signal of the multiplexer 20 from the value a of an output signal of the counter 19 to provide an output having the value of c. The second holding circuit 25 operates in response to the rise of a signal from the third position detection device 30 to receive an output having the value c from the second subtracter 26 and simultaneously to output.

A comparison circuit 27 compares the values of outputs of the counter 19 and multiplexer 20 with each other and when the values of these outputs coincide with each other, the comparison circuit 27 produces a coincidence signal H. A flip-flop $FF_2$ is reset by the rise of a signal from the timer $MS_1$ and outputs a signal L at the Q terminal of $FF_2$ at the particular time. The output at the Q terminal of $FF_2$ is inverted from L to H with a coincidence signal from the comparison circuit 27.

Figure 3:
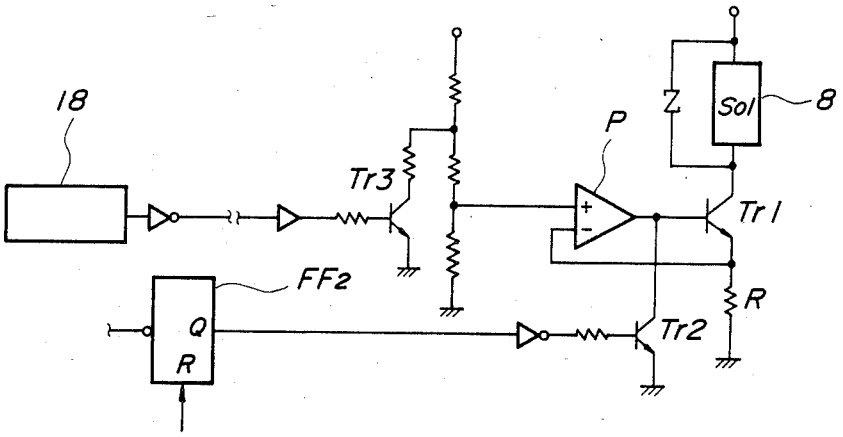
FIG. 3 is a block diagram of the operation circuit in the electrical circuit as shown in FIG. 2.

Operation circuits 28 and 29 receive signals H from $FF_2$ and open to excite their associated solenoids 8 and 9, respectively and close upon receipt of signals L from $FF_2$ to demagnetize the first and second solenoids, respectively. With the operation circuit 28 in its open condition, when the operation circuit receives a power down signal having the level L from the second position detection device 18 (when the second position detection device 18 produces a signal L), the first solenoid 8 is supplied thereto current in an amount smaller than that of current to be supplied thereto when the operation circuit 28 receives a signal L. That is, one example of the operation circuit 28 is represented by an analog circuit in FIG. 3. In FIG. 3, P denotes a known OP amplifier having comparison function and $Tr_1$, $Tr_2$ and $Tr_3$ denote transistors. When an output at the terminal Q of $FF_2$ is L, the transistor $Tr_2$ is turned on whereas the transistor $Tr_1$ is turned off resulting in the demagnetization of the first solenoid 8. On the other hand, when an output at the terminal Q of $FF_2$ is H, the transistor $Tr_2$ is turned off whereas the transistor $Tr_1$ is turned on resulting in the excitation of the first solenoid. With the transistor $Tr_2$ off, when the transistor $Tr_3$ receives a power down signal H to turn the transistor $Tr_3$ on, since the reference voltage of the OP amplifier P reduces, the value of current to be supplied to the first solenoid 8 reduces. On the other hand, when the transistor $Tr_3$ turns off upon receipt of a signal L, since the reference voltage at the ON amplifier P rises, the value of current to be supplied to the first solenoid 8 increases.

When the sewing machine is in its nonoperative condition, $FF_3$ receives a signal H at its terminal R and outputs a signal L at its terminal Q. When the sewing machine starts to operate, $FF_3$ receives a signal L at its terminal R to release its reset. Upon receipt of a signal H from an AND gate G, $FF_3$ outputs a signal H at the terminal Q. Reference numeral 45 denotes an alarm such as a buzzer or lamp and provides sound, light or other indication through a timer TM for a predetermined period when FF3 outputs a signal H at the terminal Q.

Figure 4:
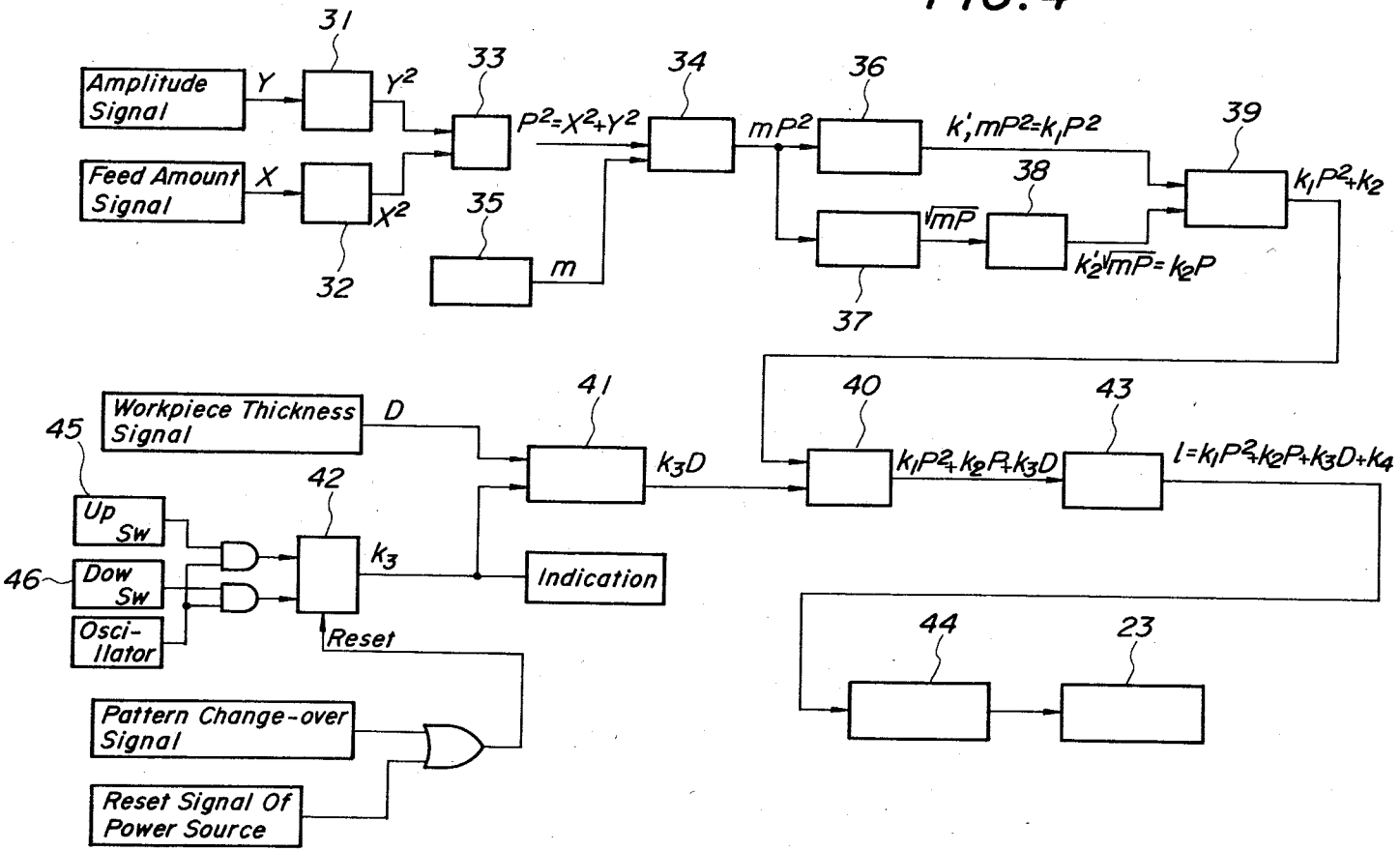
FIG. 4 is a block diagram of the second setting device incorporated in the electrical circuit as shown in FIG. 2.

Details of the second setting means 24 incorporated in the electrical circuit of FIG. 2 are shown in FIG. 4. In FIG. 4, an amplitude signal Y relating to the amplitude of the needle bar 3 and a feed amount signal X relating to the feed pitch of a workpiece are signals read out of memories such as ROM and RAM (not shown) or obtained by detecting the positions of known needle amplitude and feed adjusting devices (not shown) operable based on these signals. The detection times of these signals are detected in relation to the fall and rise of an output of the third position detection device 30 as shown in FIG. 5 and the feed amount signal X is maintained by a holding circuit (not shown) until the amplitude signal Y is detected.

These signals X and Y are processed by square multipliers 31 and 32, respectively and added together by an adder 33. An output from the adder 33 is multiplied by an output m of a feed amount (seam pitch) coefficient setting switch 35 in a multiplier 34 and an output of the multiplier 34 is processed by a $k'_1$ multiplier 36 and a square root arithmetic unit 37. An output from the square root arithmetic unit 37 is passed through a $k'_2$ multiplier 38 to an adder 39 and an output from the $k'_1$ multiplier 36 is directly passed to an adder 39. The added data is passed to an adder 40. The feed amount coefficient setting switch 35 has a code of several bits and can output a digital code corresponding to manual operation mode.

A workpiece thickness signal D corresponding to the position of the presser foot (not shown) above the upper surface of the sewing machine bed is detected in the same timing relationship as the detection of a feed amount signal X and multiplier by an output $k_3$ of a coefficient counter 42 in a multiplier 41. An output of the multiplier 41 is added to an output data from the adder 39 in an adder 40 an output of which is in turn processed through a $k_4$ adder 43.

Thus, an output of the adder 43, that is, a predetermined payingn-out amount l is represented by the quadratic equation $l=k_1P^2+k_2P+k_3D+k_4$ and P in which $k'_1m=k_1, k'_2\sqrt{m}=k_2$ and $X^2+Y^2=P$. A paying-out amount arith unit 44 converts the output of the $k_4$ adder into the number of generated pulses the paying-out detector 16 corresponding to an angle of rotation of the rotatable member 15 in proportion to a predetermined paying-out amount of the thread T whereby a digital code corresponding to the predetermined paying-out amount of the thread T is produced.

Figure 6:
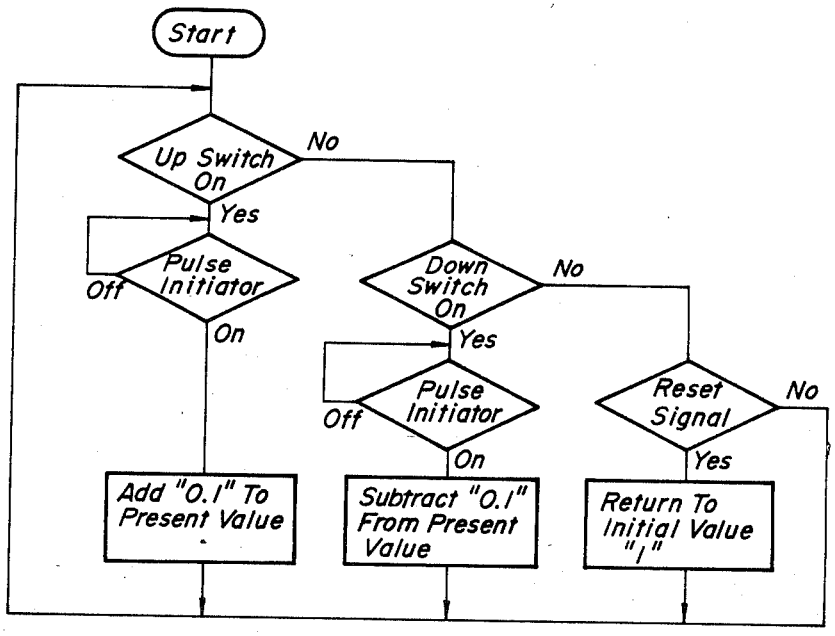
FIG. 6 is a flowchart showing the relationship between the up-down switch and coefficient counter.

As more clearly shown in the flowchart of FIG. 6, the coefficient counter 42 can vary the output value $k_3$ stepwise within a predetermined range with the initial value "1" as the center in relation to the operation of up-down switches 45 and 46 and is reset upon receipt of a signal H at the terminal R of the counter whereby an output of the counter becomes the initial value "1" and the number of pulses corresponding to the output value $k_3$ of the counter 42 is indicated on the indication window (not shown) provided in the front of the sewing machine framework. And a pattern change-over signal E and a power source input signal F are signals H which are related to the seam pattern selection operation and the closing of the power source, respectively and are generated at predetermined times.

With the above-mentioned construction and arrangement of the components of the thread feed mechanism in a sewing machine, the mechanism operates as follows:

In operation, first of all, the seam pattern selection means selects a seam pattern whereupon the first setting device 21 outputs a signal d corresponding to the inherent thread paying-out length which in turn corresponds to the selected seam pattern. Thereafter, the sewing machine starts to operation to release the reset of $FF_1$, but an output at the terminal Q of $FF_1$ remains L and an output d of the first setting device 21 is passed through the multiplexer 20 to the comparison circuit 27 and subtracter 26.

The start of the sewing machine also causes the thread take-up lever 5 which is now at the top dead center to descend until the section of the thread T extending between the thread take-up lever 5 and needle 2 slackens whereupon the counter 19 resets itself in response to the rise of a signal from the timer $MS_1$ and at the same time, since $FF_2$ clears, the operation circuit 28 closes to demagnetize the first solenoid 8 which in turn release the thread T from the nip in the holding means 6. Simultaneously, the operation circuit 29 opens to excite the second solenoid 9 to cause the holding means 7 to pinch the thread T so as to arrest the movement of the thread T therethrough.

Immediately after this, the paying-out member 12 rotates from the position as shown in FIG. 1 about the stub shaft 14 in the counterclockwise direction to flex the thread T between the two holding means 6 and 7 so as to gradually increase the length of the thread path and as a result, the thread T is payed out of the bobbin 4 in an amount corresponding to the increasement in the length of the thread path.

When the thread T is payed out of the bobbin 4 by carrying out the operation procedure described above, the rotatable member 15 is rotated in the clockwise direction as seen in FIG. 1 by the thread being payed out and the paying-out detection device 16 produces a number of pulses proportional to an angle of rotation of the rotary member 15. The pulses are counted by the counter 19 and the count is input to the comparison circuit 27 and subtracter 26. When the count value of the counter 19 coincides with the value d of an output of the first setting means 21, the comparison circuit 27 produces a coincidence signal of H which sets $FF_2$ whereby an output at the termianl Q thereof is inverted from L to H so that the first solenoid 8 is excited to cause the holding means 6 to pinch the thread T so as to prevent the thread T from further being payed out of the bobbin 4 and simultaneously demagnetize the second solenoid 9 so as to release the holding means 7 which in turn allows the thread T to pass therethrough.

Before the rotative movement of the paying-out member 12 in the counterclockwise direction ends, the comparison circuit 27 produces a coincidence signal and since the holding means 6 pinches the thread T to prevent the thread to pass therethrough whereas the holding means 7 releases its nip to allow the thread T to pass therethrough so that the thread take-up lever 5 allows the section of the thread T extending between the lever 5 and needle 2, even if the paying-out member 12 further rotates in the counterclockwise direction, slackened thread section passes through the holding means 7 and the thread section being payed out by the rotating paying-out member 12 is retained between the holding means 6 and 7 and thus, the thread T is not positively strained. If the thread is positively strained, the strained thread pulls the rest of the thread out of the bobbin 4.

Thereafter, when the thread take-up lever 5 begins to rise from the bottom dead point, the section of the thread T extending between the needle 2 and holding means 7 is gradually pulled upwardly to form a seam. While the first seam is being formed, a feed amount signal X, a workpiece thickness signal D and an amplitude signal Y are in succession detected whereby the length of thread T to be consumed for the formation of a next seam is computed and the value e of the thread length is output. Since $FF_1$ is set by the rise of a signal from the third position detection device 30 and an output at the terminal Q of $FF_1$ is inverted from L to H, a signal from the second setting device 24 is input through the multiplexer 20 to the comparison circuit 27 in a predetermined time after $FF_1$ was set or in response to the rise of an output from the timer $MS_2$.

Thus, although the thread amount to be payed out for forming the first seam is determined by a signal from the first setting device 21, the thread paying-out amount for each of the second and succeeding seams is determined by a signal from the second setting device 24 which is obtained for such seam by computing a feed pitch, a needle amplitude and a workpiece thickness. When the value of an output of the counter 19 coincides with that of an output of the multiplexer 20, the comparison circuit 27 produces a coincidence signal. By repeating the above-mentioned operation procedure, the length of thread required for each seam formation is previously payed out of the bobbin 4 into the thread path section between the holding means 6 and 7.

The above-mentioned operation is followed in the case in which the thread T is payed out an amount or length precisely corresponding to signals from the first and second setting devices 21 and 24. However, in the case in which the thread T is payed out in an excess amount into the thread path downstream of the holding means 6 in the feed direction of the thread during the time space elapsing until the counter 19 is reset after the comparison circuit 27 has produced the coincidence signal, the excess amount of thread is counted by the subtracter 26 and an output of the subtracter having the value c is input to the holding circuit 25 in response to the rise of a next signal of the position detection device 17. By this, the subtracter 23 subtracts the output value c of the subtracter 26 from the output value e of the second setting device 24 to provide an output having the value f which is passed to one input of the comparison circuit 27 through the multiplexer 20. When the value f coincides with a count output of the counter 19, the comparison circuit 27 produces a coincidence signal. The procedure is repeated.

That is, in the formation of one seam, when the length of thread to be payed out set by the first or second setting device 21 or 24 does not coincide with the length of thread actually fed to the thread path extending between the holding means 6 and 7 by the paying-out member 12, in the formation of the next seam, the length of thread is compensated for by the difference between the set and actually fed thread lengths.

While the first solenoid 8 is in its excited condition, when an output of the second detection device 18 has the value of L, the transistor $Tr_3$ turns on and the reference voltage of the OP amplifier P is substantially lower than that in a case as will be described hereinafter so that excitation current for the first solenoid 8 becomes smaller. With this condition, the holding means 6 is imparted thereto a nip force which is not so great as to feed the thread to the thread path between the holding means 6 and 7 by the operation of the paying-out member 12. When an output of the second detection device 18 is of the value H, the transistor $Tr_3$ turns off, the reference voltage of the OP amplifier P becomes higher than that in the case described just above and the excitation current for the first solenoid 8 becomes large and thus, in such a case, even if the thread T is intensely strained by the thread take-up lever 5, the holding means 6 is imparted a nip force not so great as to feed the thread T to the thread path between the holding means 6 and 7.

Since an output of the $k_4$ adder 43 which is the base on which the value e of the second setting device 24 is computed is represented by the equation $l=k_1P^2+k_2P+k_3D+k_4$, by suitably varying the value m of an output of the feed amount coefficient setting switch 35 through the manipulation thereof, the coefficients $k_1$ and $k_2$ of $P^2$ vary which in turn varies an output l of the $k_4$ adder 43 whereby an output of the second setting device 24 which is passed to one input of the comparison circuit 27 also varies. The adjustment by the feed amount coefficient setting switch 35 is performed when a feed pitch to be input the computing system does not coincide with an actual feed pitch in a sewing machine of the type in which an input signal to a feed or needle amplitude stepping motor is input to the motor in a thread paying-out computing mode.

When the up-switch 45 is manipulated, the value of the coefficient $k_3$ for a workpiece thickness signal D among outputs of the $k_4$ adder 43 becomes greater stepwise within a preset range with the initial value 1 as the center and when the down-switch 46 is manipulated, the value of the coefficient $k_3$ becomes smaller stepwise whereby an output of the second setting device 24 varies, but the coefficient counter 42 resets in response to pattern selection and power source closing and the value of $k_3$ returns to the initial value 1. The adjustment is made as desired when the balance in tension between upper and lower threads is intentionally varied in order to sew a single workpiece with gathers or two workpieces having different lengths with the longer workpiece gathered or pull the lower or upper thread in sewing.

When the thread T is not present between the holding discs 10 in the holding means 6, the thread T tends to be payed out of the bobbin 4 as the thread take-up lever 5 strains the thread even when the paying-out member 12 does not pay the thread out of the bobbin 4, but since the reset of the $FF_3$ is released during the operation of the sewing machine and an output having the value H of the first position detection device 17 opens the gate G while the lever 5 is straining the thread, when the thread T is payed out to rotate the rotatable member 15, a pulse from the detection device 16 sets $FF_3$ to operate the timed alarm through the timer TM.

As mentioned hereinabove, according to one aspect of the present invention, the thread feed mechanism in a sewing machine comprises a first signal generation device for producing a thread feed amount signal X corresponding to a workpiece feed pitch for each seam and an amplitude signal Y corresponding to the amplitude of a needle bar in response to the operation of the sewing machine before a thread takeup lever completes the straining of an indefinite length of thread, a second signal generation device for detecting the thickness of a workpiece at the sewing area in the sewing machine before the lever completes the straining of the thread and producing a workpiece thickness signal D corresponding to the thickness of said workpiece, first means 31, 32 and 33 for adding square values of the feed amount and needle amplitude signals together and outputting the added value, second means 37 and 38 for multiplying square root of the output of the first means by a coefficient $k'_2$ and outputting the multiplied value, third manual means 45, 46 and 42 for outputting signals of different values corresponding to operation modes of the third means, fourth means 41 for multiplying the workpiece thickness signal by the output of the third means and outputting the multiplied value, and fifth means 40 for adding the outputs of the third and fourth means together whereby paying-out means is controlled using the output of the fifth means as a setting signal or the reference data for setting. Thus, by varying the balance in tension between the upper and lower threads through the manipulation of the third means, it is possible to sew a single workpiece with gathers or two workpieces of different lengths with the longer one gathered or pull the upper or lower thread in sewing whereby the sewing machine can perform a variety of functions. In addition, when the sewing operation is operated for sewing workpieces having different thicknesses by varying the balance in tension between the upper and lower threads because the varied balance in tension between the upper and lower threads is maintained so that high quality seams in which the threads have an uniform tension can be obtained.

According to another aspect of the present invention, the thread feed mechanism in a sewing machine comprises a first signal generation device for producing a feed amount signal X corresponding to a workpiece feed pitch for each seam and an amplitude signal Y corresponding to the amplitude of a needle bar in response to the operation of the sewing machine before a thread take-up lever completes the straining of an indefinite length of thread, a second signal generation device for detecting the thickness of a workpiece at the sewing area in the sewing machine before the lever completes the straining of the thread and producing a workpiece thickness signal D corresponding to the thickness of the workpiece, first means 31, 32 and 33 for adding square values of the feed amount and amplitude signals and outputting the resulting value, manual seam pitch coefficient setting means 35 for producing a signal m which varies depending upon the operation mode of said coefficient setting means, second means 37 and 38 for multiplying the output of the first means by the output of the coefficient means and outputting the resulting value, third means 45, 46 and 42 for multiplying a square root of the output of said second means by a coefficient $k'_2$ and outputting the resulting value, and fourth means for adding the output of said third means and said workpiece thickness signal together and outputting the resulting value, whereby a paying-out device is controlled using the output of the fourth means as a setting signal or the reference data for the setting signal. Thus, even when there are variations of tolerances of parts are present by suitably manipulating the seam pitch coefficient setting means 35 so as to vary the coefficient of the seam pitch, adjustment can be simply performed to square an indicated feed pitch with an actual feed pitch whereby the paying-out amount of the thread can be precisely controlled resulting in improvement of the quality of a sewn product.

In the illustrated embodiment, although the paying-out member 12 in the form of a bar is adapted to reciprocally move as the cam member 13 rotates, the paying-out member may be formed in the periphery thereof with a cam face in opposition to the thread path as shown in Japanese Patent Application No. 82712/1982 without departing the scope of the invention.

And althouth the two holding means are controlled based on a set signal in the illustrated embodiment, the holding means may be replaced by a disc having a length of thread wound about the outer periphery or a pair of opposing rollers having a length of thread nipped therebetween with one of the rollers being rotated by a stepping motor based on a set signal.

Furthermore, in the illustrated embodiment, although the first and second setting devices 21 and 24 are provided and the first setting device 21 produces a digital code corresponding to an average ideal thread paying-out length which varies depending upon a selected seam pattern, it may be also possible to produce the same digital code for all seam patterns.

Finally, in the illustrated embodiment, although the pertinent thread paying-out length l is sought by the equation $l=k_1P^2+k_2P+k_3D+k_4$, the paying-out length may be sought by the equation $l=k_2P+k_3D$ within the scope of the invention.

While only one embodiment of the invention has been shown and described in detail, it will be understood that the same is for illustration purpose only and not to be taken as a definition of the invention, reference being had for the purpose to the appended claims.

What is claimed is:

1. In a thread feed mechanism in a sewing machine in which thread in a length corresponding to a set signal is payed out of a supply source by a paying-out device which operates based on said set signal each time a seam is to be formed and fed to a thread take-up lever, characterized by:

a first signal generation device for producing a feed amount signal X corresponding to a workpiece pitch for one seam and an amplitude signal Y corresponding to the amplitude of a needle bar in response to the operation of said sewing machine before said lever completes the straining of said thread in said seam;

a second signal generation device for detecting the thickness of a workpiece at the sewing area of said sewing machine and producing a workpiece thickness signal D corresponding to said thickness before said thread take-up lever completes the straining of the thread in said seam;

first means 31, 32 and 33 for adding square values of said feed amount and amplitude signals together and outputting the resulting value;

second means for multiplying a square root of the output of said first means by a coefficient $k'_2$ and outputting the resulting value;

third means for producing a signal $k_3$ which varies depending upon the operation mode of said third means;

fourth means for multiplying said workpiece thickness signal by the output of said third means and outputting the resulting value; and fifth means for adding the outputs of said second, third and fourth means together and outputting the resulting value, whereby the output of said fifth means is made a set signal or the reference data for said set signal.

2. In a thread feed mechanism in a sewing machine in which thread in a length corresponding to a set signal is payed out of a supply source by a paying-out device which operates based on said set signal each time a seam is to be formed and fed to a thread take-up lever, characterized by:

a first signal device for producing generating a feed amount signal corresponding to a workpiece feed pitch for one seam and an amplitude signal corresponding to the amplitude of a needle bar in response to the operation of said sewing machine before said lever completes the straining of the thread in said seam;

a second signal generation device for detecting the thickness of a workpiece at the sewing area of said sewing machine and producing a workpiece thickness signal corresponding to the thickness of said workpiece before said thread take-up lever completes the straining of the thread in said seam;

first means for adding square values of said feed amount and amplitude signals together and outputting the resulting value; manual seam pitch coefficient setting means for producing a signal m the value of which varies depending upon the operation mode of said coefficient setting means;

second means for multiplying the output of said coefficient setting means and the output of said first means and outputting the resulting value;

third means for multiplying a square root of the output of said second means by a coefficient $k'_2$ and outputting the resulting value; and fourth means for adding the output of said third means and said workpiece thickness signal together and outputting the resulting value, whereby the output of said fourth means is made a set signal or the reference data for said set signal.

* * * * *